US005746256A

United States Patent [19]

Wahhoud et al.

[11] Patent Number: 5,746,256

[45] Date of Patent: May 5, 1998

[54] METHOD AND APPARATUS FOR A CONTROLLED PNEUMATIC REMOVAL OF A FAULTY WEFT THREAD IN AN AIR JET LOOM

[75] Inventors: Adnan Wahhoud, Lindau-Boldolz, Germany; Josef Hehle, Heorbranz, Austria

[73] Assignee: Lindauer Dornier Gesellschaft mbH, Lindau, Germany

[21] Appl. No.: 664,307

[22] Filed: Jun. 10, 1996

[30] Foreign Application Priority Data

Jun. 9, 1995 [DE] Germany ..... 195 21 100.6

[51] Int. Cl.[6] ..... D03D 51/34

[52] U.S. Cl. ..... 139/116.2

[58] Field of Search ..... 139/116.2

[56] References Cited

U.S. PATENT DOCUMENTS

| | | | |
|---|---|---|---|
| 4,781,221 | 11/1988 | Onishi et al. . | |
| 5,046,532 | 9/1991 | Kano et al. | 139/116.2 |
| 5,050,647 | 9/1991 | Baeck et al. | 139/116.2 |
| 5,226,458 | 7/1993 | Bamelis | 139/116.2 |
| 5,297,592 | 3/1994 | Takegawa | 139/116.2 |

FOREIGN PATENT DOCUMENTS

| | | | |
|---|---|---|---|
| 0207470 | 1/1987 | European Pat. Off. . | |
| 0309013 | 3/1989 | European Pat. Off. . | |
| 0310804 | 4/1989 | European Pat. Off. . | |
| 03222576 | 7/1989 | European Pat. Off. . | |
| 0330023 | 8/1989 | European Pat. Off. . | |
| 0332258 | 9/1989 | European Pat. Off. . | |
| 0534541 | 3/1993 | European Pat. Off. . | |
| 0167048 | 7/1986 | Japan | 139/116.2 |
| 1156553 | 12/1987 | Japan | 139/116.2 |

*Primary Examiner*—Andy Falik

*Attorney, Agent, or Firm*—W. G. Fasse; W. F. Fasse

[57] ABSTRACT

A method and apparatus remove a faulty weft thread from a beat-up edge or cloth fell by pulling its leading end with a pneumatic thread removal device, which adaptably takes into account the thread characteristics and particularly the twist of the thread. The method maintains the twist of the thread by generating a simultaneously sucking and rotating airflow in the thread removal device, wherein the direction of rotation of the flow is controlled to coincide with the direction of the twist of the weft thread. The pneumatic thread removal device includes an injector nozzle with at least two gas flow inlet ports oriented to respectively cause oppositely rotating suction flows through the nozzle, and a controllable throttle valve to selectively direct a gas flow to the inlet ports.

19 Claims, 2 Drawing Sheets

METHOD AND APPARATUS FOR A CONTROLLED PNEUMATIC REMOVAL OF A FAULTY WEFT THREAD IN AN AIR JET LOOM

FIELD OF THE INVENTION

The invention relates to the controlled pneumatic removal, from an open loom shed, of a faulty and twisted, mono-filament or multi-filament weft thread that has caused a stop in weaving operations, and to an apparatus for carrying out the method.

BACKGROUND INFORMATION

In air jet looms, a twisted single-ply or multi-ply (i.e. mono-filament or multi-filament) weft thread, for example, is inserted into a loom shed and transported across the weaving width by suitable nozzles, and is then beat up against the beat-up edge or fell of the cloth by a weaving reed. In this context, the insertion of the weft thread and the controlled activation of the nozzles necessary for the insertion is carried out dependent upon certain parameters that are specific to the weft thread. Such thread specific parameters include, for example, the thickness, the density or weight per unit length, and the surface properties such as the texture of the thread.

In some cases, circumstances will occur that require an inserted weft thread to be sucked away from or otherwise removed from the beat-up edge of the fabric, for example, when a faulty weft thread insertion triggers a weaving stop. Specific details of such fault conditions and various methods, particularly for removing a faulty weft thread, are known from Published European Patent Applications 0,310,804; 0,309,103; and 0,207,470; and U.S. Pat. No. 4,781,221. The disclosure of the just mentioned patent publications is incorporated herein by reference. The basic steps of the known methods disclosed in the above mentioned patent publications include: recognition of a faulty insertion of the weft thread; interruption of the weaving operation, i.e. a weaving stop; insertion of another weft thread as a repair thread to separate the inserted faulty weft thread from the beat-up edge or cloth fell; and pneumatic removal of the weft and the repair thread together as one thread, which is achieved either by a suitable negative pressure or suction of a suction nozzle, or by an injector nozzle, arranged downstream from the loom shed exit.

Generally a sensor is provided that senses whether a weft thread is being held by the thread removal device or the weft thread has already been completely peeled-off or pulled-out and removed from the beat-up edge or cloth fell. Typically, such sensors operate optically and are known in the art in different configurations. Such sensors cannot reliably recognize or detect a weft thread that is moving only in the direction of its longitudinal axis. A thread removal device is therefore used that also sets the thread in motion perpendicular to its longitudinal axis. The above mentioned injector nozzles are used to impart this perpendicular motion to the thread. With these nozzles, an airflow of increased pressure is introduced, offset from the center of the injector nozzle, and then flows in the circumferential direction of the injector nozzle and thus imparts a certain twist to the twisted weft thread.

A problem of the prior art methods for removing the inserted weft thread is that the thread removal is always carried out in a completely constant manner, i.e. the thread removal is not adapted to the type of twist or to other characteristics specific to the particular respective weft thread. Applying a constant or uniform twist to the faulty weft thread according to the known methods can cause the thread to untwist in some circumstances. Particularly with single-ply or mono-filament weft threads that are essentially held together by the twist applied to the thread, a sucking flow that rotates in the direction opposite to the twist of the weft thread can cause the weft thread to unwind or untwist. This results in time-consuming and unreliable removal of a weft thread fault.

OBJECTS OF THE INVENTION

In view of the above it is the aim of the invention to achieve the following objects singly or in combination:

- to provide a method and an apparatus for pneumatically removing or pulling a weft thread from the beat-up edge or fell of a woven cloth in a loom, wherein a reliable pulling and suctioning off of the weft thread is achieved;
- to provide such a method applicable to air jet looms for reliably preventing a twisted single-ply or multi-ply weft thread from untwisting, or even for reinforcing its twist, when it is being removed from the loom shed;
- to provide a method and an apparatus whereby the characteristics of a sucking rotational flow applied to the thread to be removed are adaptable to certain specific characteristics or parameters of the thread, such as the direction and degree of twist and the strength of the thread;
- to provide a method and an apparatus that will improve removal of a faulty twisted single-ply or multi-ply weft thread by avoiding time-consuming and error-prone removal of a weft thread that has become untwisted and/or broken; and
- to automatically adapt the thread removal conditions to a particular respective weft thread that is to be removed, even when several different types of weft thread are being used in a weaving operation.

SUMMARY OF THE INVENTION

The above objects have been achieved in an air jet loom by a method according to the invention wherein the pneumatic removal of a faulty and twisted, single-ply or multi-ply weft thread from the beat-up edge or cloth fell is carried out with a simultaneously sucking and rotating airflow that is controlled dependent upon certain thread specific parameters. More particularly, the rotation direction and the strength of the sucking rotational flow applied to the faulty weft thread is adapted to certain specific characteristics of the thread.

The above objects have further been achieved in an apparatus according to the invention wherein the controlled rotational suction flow is achieved in a thread removal device arranged at the outlet or exit side of the loom shed. The thread removal device is particularly embodied as an injector nozzle with at least two injector inlets, and at least two pressure reservoirs are connected to the thread removal device. It is also possible to use any other type of pneumatic thread removal device with which it is possible to carry out the method. Applying the appropriate rotation to the sucking flow and adjusting the strength of the sucking flow can also be achieved in any other desired manner. Injector nozzles are not absolutely necessary for this invention, for example, flow baffles that can be correspondingly adjusted or similar devices can also be used.

An important feature of the present invention is that a simultaneously sucking and rotating flow is generated in the thread removal device arranged at the exit side of the loom shed and is adapted to the characteristics of the thread. In a preferred embodiment, the direction of rotation and/or strength of the sucking flow are adapted to the corresponding thread specific parameters. Hence, in addition to thread specific parameters that are used in the prior art, the direction of twist of the weft thread and other additional parameters as required, such as the tensile strength for example, are input into the loom control. It is also possible to determine these parameters directly from the respective thread by suitable sensor devices for automatically adapting the thread removal conditions. A substantial advantage of the invention in this preferred embodiment is that it becomes impossible for the thread to untwist. In fact, the characteristic twist of the thread can be maintained or even reinforced. This leads to an improved removal of the weft thread.

Furthermore, since the force or strength of the sucking flow is adjustable by using adjustable valves or throttles, the thread peeling and removal operation can be optimized by adapting the force of the flow to the specific strength characteristic of the thread to be removed. This leads to a reduction in energy consumption and bothersome noise, and overall, to an optimized pneumatic removal of the weft thread.

In processing different weft threads, particularly when weaving a cloth for which several different weft threads are inserted, the relevant thread specific parameters for each of the respective weft threads are pre-specified in the control of the loom. This loom control has information as to which weft thread was just inserted, so in the case of a loom stop due to a faulty weft insertion, the loom control can correspondingly control the pneumatic thread removal operation dependent upon the thread specific parameters of the particular thread that was faulty.

BRIEF DESCRIPTION OF THE DRAWINGS

In order that the invention may be clearly understood, it will now be described by way of example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
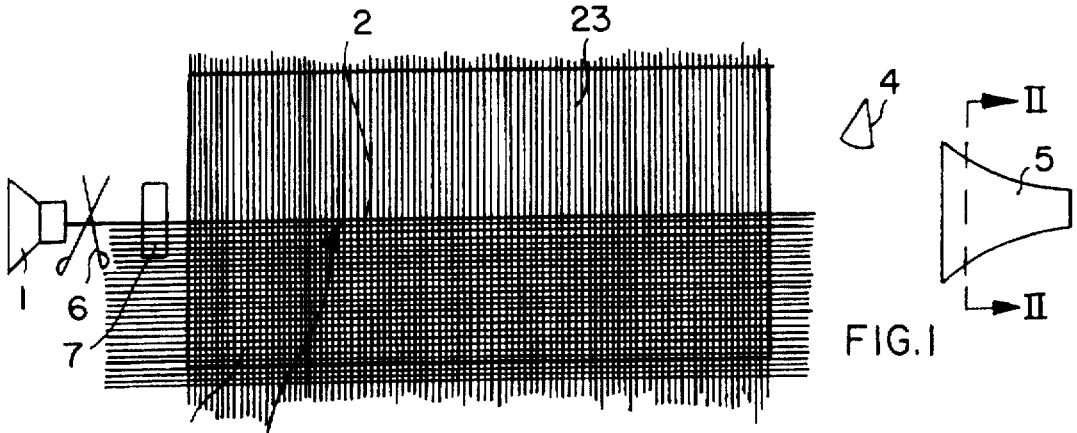
FIG. 1 schematically illustrates an air jet loom according to the invention.

According to FIG. 1 a main nozzle 1, which is arranged in a per se known manner, inserts a weft thread 2 along the beat-up edge or fell 3A of a woven cloth 3 in a loom shed 23. A weft thread sensor 4 and a thread removal device 5 are arranged at the exit end of the loom shed 23. A cutting device 6 and a clamping device 7 are arranged between the entry side of the loom shed 23 and the main nozzle 1. The thread removal device 5 is constructed to apply a simultaneously sucking and rotating airflow, which is controlled according to the invention as described above, for removing a faulty weft thread once the sensor 4 detects the occurrence of the weft fault and triggers a loom stop.

Figure 2:
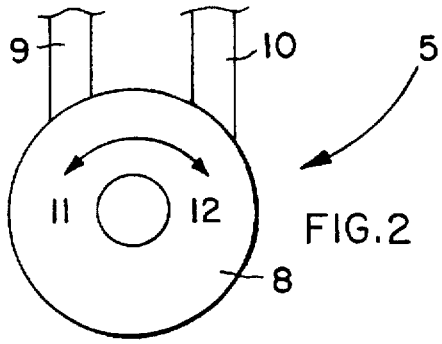
FIG. 2 shows a schematic cross-section through the thread removal device of the loom of FIG. 1, taken along section line II—II.

In a preferred embodiment of the invention according to FIG. 2, the thread removal device 5 is constructed as an injector nozzle 5. An inner space 8 of the injector nozzle 5 is pressurized from either the inlet 9 or inlet 10. As will be understood by persons of ordinary skill in the art, the inlets 9 and 10 include injector ports arranged to cause a rotational and sucking flow into the injector nozzle 5. Pressurization of the nozzle 5 from inlet 9 consistently results in a rotation of the sucking flow in direction 11, while pressurization from inlet 10 generates a rotation of the sucking flow in direction 12. Depending on the twist of the particular weft thread 2 that is to be removed, either inlet 9 or inlet 10 of the thread removal device 5 is pressurized, resulting in a rotation of the sucking flow in a direction 11 or 12 that coincides with the direction of twist of the weft thread 2. In this manner, the thread removal device 5 reliably removes the weft thread 2, while successfully preventing the weft thread 2 from untwisting and breaking due to such untwisting.

Figure 3:
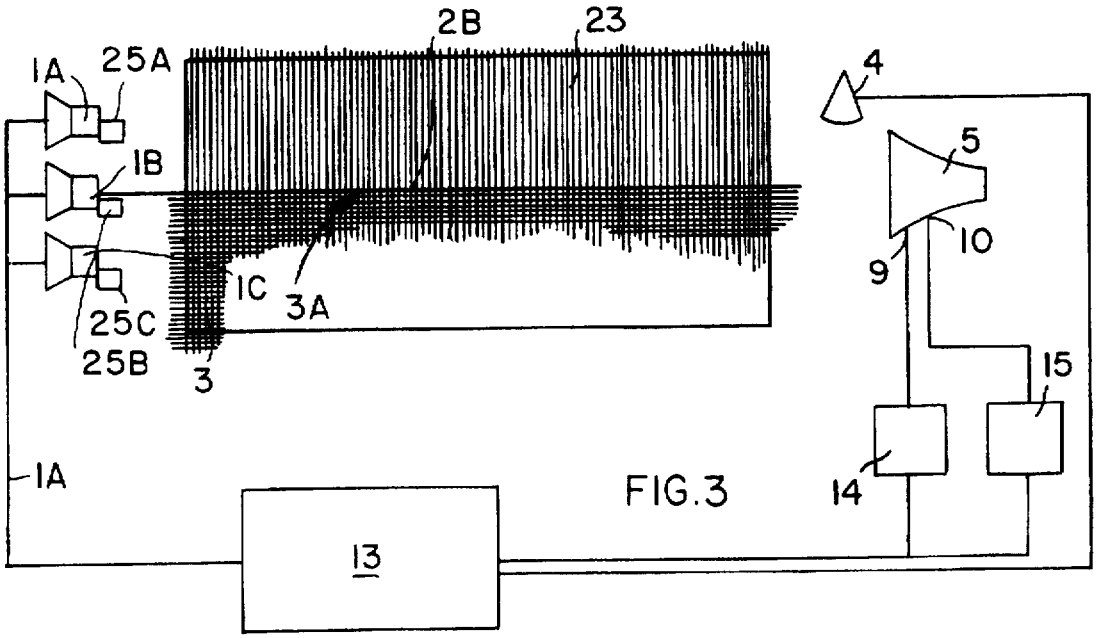
FIG. 3 schematically illustrates another air jet loom according to the invention, with pressure accumulators.

FIG. 3 shows an embodiment of the invention for a situation in which different weft threads are woven into a cloth. Three main nozzles 1A,1B,1C are shown in this embodiment for inserting three different types of weft threads, whereby it should be understood that more or fewer main nozzles or types of weft thread can alternatively be provided. In the case shown in FIG. 3, the weft thread 2B has been inserted by the main nozzle 1B and has resulted in a weft fault as detected by the sensor 4, so the thread 2B should be removed from the beat-up edge or fell 3A of the cloth 3 by the thread removal device 5.

A loom control 13 has been provided with information regarding the thread specific parameters, such as the thread twist direction, twist degree, density, tensile strength, surface texture, and the like, of the weft thread 2B that is inserted by the main nozzle 1B. For example, the pertinent thread specific parameters can be manually pre-programmed into the loom control 13, or can be automatically sensed from the respective threads by appropriate sensors 25A, 25B, and 25C provided for the three main nozzles 1A, 1B, and 1C. The thread characteristic sensors 25A, 25B, and 25C, which are generally known in the art, provide the required parameter information to the loom control 13 via signal conductors 1A. The loom control 13 also receives via conductors 1A information as to which main nozzle 1A, 1B, 1C delivered the last weft insertion. The loom control 13 can therefore access the characteristics specific to the weft thread 2B that was inserted. Now, depending on the thread specific parameters of the thread 2B, either a first pressure source such as an accumulator 14 or a second pressure source such as an accumulator 15 is activated to respectively pressurize either the inlet 9 or the inlet 10 of the thread removal device 5, which is constructed for example as shown in FIG. 2. This results in a pneumatic removal of the weft thread 2B whereby the direction of pneumatic rotation is controlled to correspond to the direction of twist of the thread 2B. In a particular embodiment, the two pressure accumulators 14 and 15 are pressurized to different pressure levels in any manner known in the art.

Figure 4:
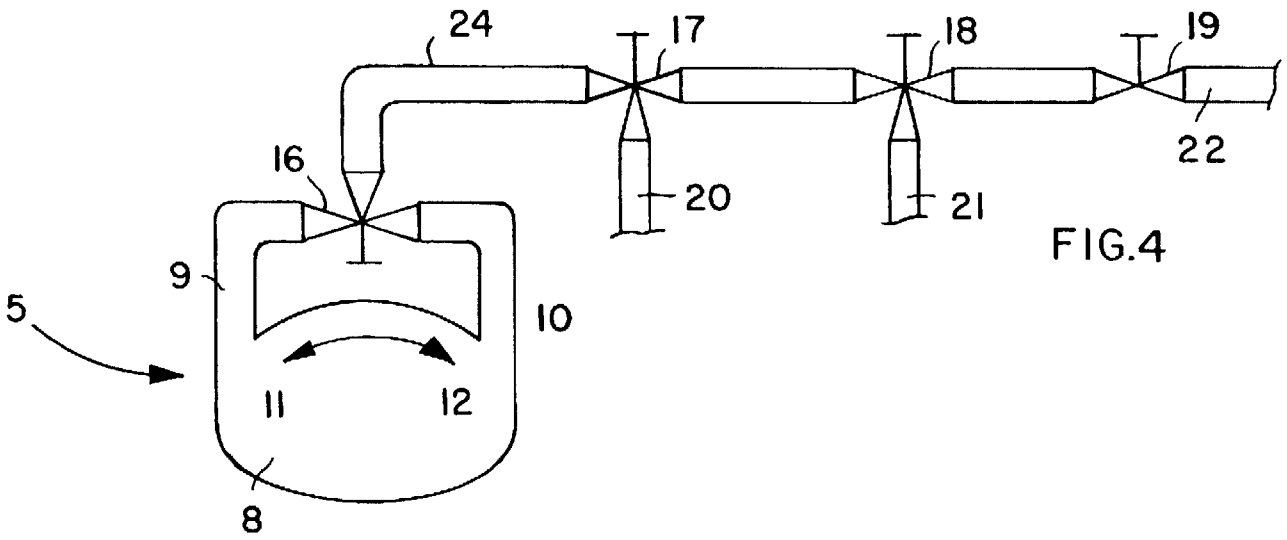
FIG. 4 schematically illustrates an arrangement for the controlled pressurization of the thread removal device.

A further possibility for controlling the removal of a weft thread is presented in the embodiment according to FIG. 4. The inlets 9,10 of the thread removal device 5 are connected with each other by a suitable throttle valve 16. The airflow amount provided to each of the inlets 9 and 10 can be adjusted by the throttle valve 16, whereby the suction force and the degree and direction of the rotational effect can be adjusted dependent on the tensile strength and the characteristic twist of the thread, for example. Pressurized gas, such as air, is provided to the throttle valve 16 by a manifold 24 which is supplied with the pressurized gas such as air by one or more of three valves 17, 18, and 19. Depending on the position of the valves 17, 18, 19, the valve inlet of the throttle valve 16 will be pressurized by one or more of the pressure lines 20, 21, and/or 22, whereby only one pressure line or several pressure lines together can be used for adjusting the final pressurization. The loom control 13 controls the opening and closing of the individual valves 16 to 19 corresponding to the thread specific parameters of the weft thread specified in the loom control 13.

It should be understood that the features of the invention described in connection with FIG. 4 can also be used together with the features described in connection with FIG. 3. For example, one or more of the valves 16 to 19 can be interposed between the pressure accumulators 14 and 15 and the thread removal device 5.

Overall, with the method and apparatus of the invention, a simultaneously sucking and rotating flow is generated that can be optimally adapted to each respective weft thread that is inserted.

Although the invention has been described with reference to specific example embodiments, it will be appreciated that it is intended to cover all modifications and equivalents within the scope of the appended claims.

What is claimed is:

1. A method for pneumatically removing a faulty twisted weft thread from a cloth fell of a cloth being woven on an air jet loom including a thread removal device arranged at an exit side of a loom shed of said loom, comprising the following steps:

a) stopping a weaving operation of said loom;

b) opening said loom shed of said loom;

c) generating a simultaneously sucking and rotating gas flow in said thread removal device; and d) controlling said generating of said gas flow dependent upon at least one thread specific parameter of said weft thread comprising a direction of twist of said weft thread.

2. The method according to claim 1, wherein said step d) comprises controlling a rotation direction of said sucking and rotating gas flow dependent upon said direction of twist of said weft thread.

3. The method according to claim 2, wherein said rotation direction of said sucking and rotating gas flow is controlled to match said direction of twist of said weft thread.

4. The method according to claim 1, wherein said at least one thread specific parameter further comprises a tensile strength of said weft thread.

5. The method according to claim 4, wherein said step d) further comprises controlling a suction force of said sucking and rotating gas flow to apply a traction force to said weft thread that is below said tensile strength.

6. The method according to claim 5, wherein said step d) further comprises controlling a rotation direction of said sucking and rotating gas flow to match said direction of twist of said weft thread.

7. The method according to claim 1, wherein said loom further includes a loom control, and said method further comprises automatically sensing and measuring said at least one thread specific parameter of said weft thread, and providing a signal corresponding to said at least one thread specific parameter to said loom control of said loom.

8. The method according to claim 1, wherein said loom further includes a loom control, and said method further comprises pre-specifying said at least one thread specific parameter as at least one corresponding fixed value in said loom control of said loom.

9. The method according to claim 1, wherein said loom further includes a loom control, wherein said weaving operation comprises weaving said cloth with a plurality of different types of weft threads respectively having different values for said at least one thread specific parameter, and further comprising providing to said loom control information identifying said faulty weft thread as belonging to a particular one of said different weft thread types, and automatically accessing with said loom control said at least one thread specific parameter respectively associated with said particular weft thread type.

10. An apparatus for pneumatically removing a faulty twisted weft thread from a cloth fell of a cloth being woven on an air jet loom, said apparatus comprising a pneumatic thread removal device adapted to be arranged at a weft exit side of a loom shed of said loom and a plurality of pressure accumulators selectably connected to said thread removal device, wherein said thread removal device comprises an injector nozzle having at least two gas flow inlet ports opening into an inner space of said nozzle and respectively directed to cause respective oppositely rotating and suctioning gas flows through said nozzle.

11. The apparatus according to claim 10, wherein said plurality of pressure accumulators consists of two pressure accumulators respectively connected to said two gas flow inlet ports.

12. The apparatus according to claim 10, wherein said pressure accumulators respectively contain a gas that is pressurized to different pressure levels respectively in said pressure accumulators.

13. The apparatus according to claim 10, wherein said thread removal device further comprises at least one adjustable throttle valve interposed between said pressure accumulators and said gas flow inlet ports.

14. The apparatus according to claim 10, further comprising a loom control adapted to store at least one thread specific parameter of said faulty weft thread therein, and control signal conductors connecting said loom control with said pressure accumulators.

15. The apparatus according to claim 14, further comprising a thread characteristic sensor adapted to sense said thread specific parameter from said weft thread, and a signal conductor connecting said thread characteristic sensor with said loom control.

16. An apparatus for pneumatically removing a faulty twisted weft thread from a cloth fell of a cloth being woven on an air jet loom, said apparatus comprising a pneumatic thread removal device adapted to be arranged at a weft exit side of a loom shed of said loom, wherein said thread removal device comprises an injector nozzle having at least two gas flow inlet ports opening into an inner space of said nozzle and respectively directed to cause respective oppositely rotating and suctioning gas flows through said nozzle, and a controllable throttle valve interposed between and connecting together said two gas flow inlet ports of said injector nozzle.

17. The apparatus according to claim 16, wherein said throttle valve has one pressurized gas inlet port and two adjustably selectable outlet ports respectively connected to said two gas flow inlet ports of said injector nozzle.

18. The apparatus according to claim 17, further comprising a plurality of pressurized gas supply lines and a plurality of selector valves selectably connecting at least one of said plurality of pressurized gas supply lines to said pressurized gas inlet port of said throttle valve.

19. The apparatus according to claim 18, wherein each of said selector valves is an adjustable pressure valve.

* * * * *

UNITED STATES PATENT AND TRADEMARK OFFICE

CERTIFICATE OF CORRECTION

PATENT NO. : 5,746,256

DATED : May 5, 1998

INVENTOR(S) : Wahhoud et al.

It is certified that error appears in the above-indentified patent and that said Letters Patent is hereby corrected as shown below:

On the Title Page:

Item [75] Inventors: line 2, replace "Heorbranz" by --Hoerbranz--.

In References Cited FOREIGN PATENT DOCUMENTS:
line 4, replace "03222576" by --0322576--;
line 8, replace "0167048" by --1167048--.

Col. 1, line 7, after 'to" insert --a method for--.

Signed and Sealed this

Fourteenth Day of July, 1998

Bruce Lehman

*Attest:*

BRUCE LEHMAN

*Attesting Officer*

*Commissioner of Patents and Trademarks*